US005682858A

United States Patent [19]

Chen et al.

[11] Patent Number: 5,682,858

[45] Date of Patent: Nov. 4, 1997

[54] HYDRAULICALLY-ACTUATED FUEL INJECTOR WITH PRESSURE SPIKE RELIEF VALVE

[75] Inventors: Shikui K. Chen, Peoria; Gregory W. Hefler, Chillicothe, both of Ill.

[73] Assignee: Caterpillar Inc., Peoria, Ill.

[21] Appl. No.: 734,940

[22] Filed: Oct. 22, 1996

[51] Int. Cl.[6] ..... F02M 41/00

[52] U.S. Cl. ..... 123/467

[58] Field of Search ..... 123/446, 447, 123/467, 506

[56] References Cited

U.S. PATENT DOCUMENTS

| | | | |
|---|---|---|---|
| 4,577,606 | 3/1986 | Bohringer et al. | 123/506 |
| 4,957,090 | 9/1990 | Rathmayr et al. | 123/501 |
| 5,025,768 | 6/1991 | Eckert | 123/506 |
| 5,143,291 | 9/1992 | Grinsteiner | 239/88 |
| 5,150,684 | 9/1992 | Jun | 123/446 |
| 5,339,786 | 8/1994 | Martin | 123/467 |
| 5,441,029 | 8/1995 | Hlousek | 123/467 |
| 5,492,098 | 2/1996 | Hafner et al. | 123/446 |
| 5,526,792 | 6/1996 | Guth et al. | 123/467 |

*Primary Examiner*—Thomas N. Moulis
*Attorney, Agent, or Firm*—Liell & McNeil

[57] ABSTRACT

A hydraulically-actuated fuel injector includes an injector body having a nozzle chamber, a nozzle outlet, an actuation fluid inlet, an actuation fluid drain, an actuation fluid cavity and a pressure relief passage extending between the actuation fluid cavity and the actuation fluid drain. A hydraulic means, including an actuation fluid control valve mounted within the injector body, is used for pressurizing fuel in the nozzle chamber. A needle valve member is mounted to reciprocate in the nozzle chamber between an open position in which the nozzle outlet is open and a closed position in which the nozzle outlet is closed. A relief valve is mounted within the injector body and has a first position in which the pressure relief passage is closed and a second position in which the pressure relief passage is open.

20 Claims, 4 Drawing Sheets

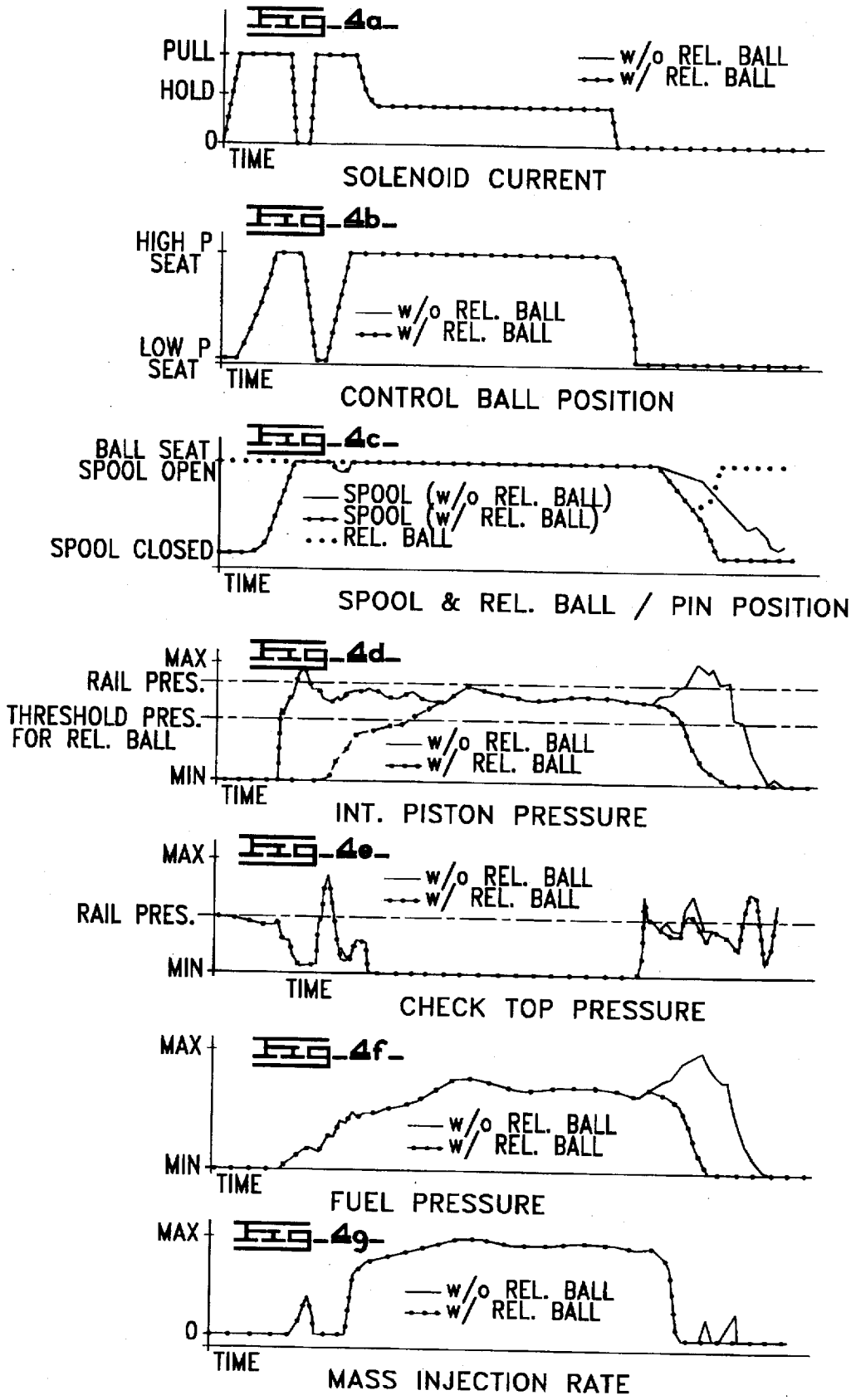
Fig-4a
PULL
HOLD
0
TIME
w/o REL. BALL
w/ REL. BALL
SOLENOID CURRENT
Fig-4b
HIGH P SEAT
LOW P SEAT
TIME
w/o REL. BALL
w/ REL. BALL
CONTROL BALL POSITION
Fig-4c
BALL SEAT
SPOOL OPEN
SPOOL CLOSED
TIME
SPOOL (w/o REL. BALL)
SPOOL (w/ REL. BALL)
REL. BALL
SPOOL & REL. BALL / PIN POSITION
Fig-4d
MAX
RAIL PRES.
THRESHOLD PRES. FOR REL. BALL
MIN
TIME
w/o REL. BALL
w/ REL. BALL
INT. PISTON PRESSURE
Fig-4e
MAX
RAIL PRES.
MIN
TIME
w/o REL. BALL
w/ REL. BALL
CHECK TOP PRESSURE
Fig-4f
MAX
MIN
TIME
w/o REL. BALL
w/ REL. BALL
FUEL PRESSURE
Fig-4g
MAX
0
TIME
w/o REL. BALL
w/ REL. BALL
MASS INJECTION RATE

HYDRAULICALLY-ACTUATED FUEL INJECTOR WITH PRESSURE SPIKE RELIEF VALVE

TECHNICAL FIELD

The present invention relates generally to fuel injection, and more particularly to hydraulically-actuated fuel injectors with means for avoiding and/or dissipating pressure spikes in the actuation fluid within the injector.

BACKGROUND ART

Known hydraulically-actuated fuel injection systems and/or components are shown, for example, in U.S. Pat. No. 5,121,730 issued to Ausman et al. on Jun. 16, 1992; U.S. Pat. No. 5,271,371 issued to Meints et al. on Dec. 21, 1993; and U.S. Pat. No. 5,297,523 issued to Hafner et al. on Mar. 29, 1994. In these hydraulically actuated fuel injectors, a spring biased needle check opens to commence fuel injection when pressure is raised by an intensifier piston/plunger assembly to a valve opening pressure. The intensifier piston is acted upon by a relatively high pressure actuation fluid, such as engine lubricating oil, when a solenoid driven actuation fluid control valve opens the injector's high pressure inlet. Injection is ended by deactivating the solenoid to release pressure above the intensifier piston. This in turn causes a drop in fuel pressure causing the needle check to close under the action of its return spring to end injection. While these hydraulically actuated fuel injectors have performed magnificently over many years, there remains room for improvement, especially in the area of shaping an injection rate trace from beginning to end to precisely suit a set of engine operating conditions.

One innovation that has been introduced recently to afford some ability to control the injection rate trace is by opening and closing the nozzle outlet by controlling the exposure of the end of the needle valve member to either low or high pressure, respectively. When the end hydraulic surface of the needle valve member is exposed to low pressure, it operates as a conventional needle check in that it opens when fuel pressure rises above a valve opening pressure sufficient to overcome a return spring. When the end of the needle valve member is exposed to high pressure, it is held closed despite the presence of high fuel pressure acting upon the opposite lifting surfaces of the needle valve member. This innovation is more thoroughly introduced and discussed in co-owned U.S. Pat. No. 5,463,996 entitled Hydraulically-Actuated Fluid Injector Having Pre-Injection Pressurizable Fluid And Direct-Operated Check and its progeny applications and/or patents. With this innovation of a direct control needle valve came a new problem which was rarely encountered in earlier hydraulically-actuated fuel injectors. In particular, since the needle valve can close while the piston/plunger are in their downward stroke and fuel is above valve opening pressure, pressure spikes can be generated over some operating conditions of the injector. In some instances, these pressure spikes in the actuation fluid can cause a brief secondary injection.

The present invention is intended to improve the ability of hydraulically-actuated fuel injectors to dissipate pressure spikes, or avoid pressure spike conditions, in the actuation fluid.

DISCLOSURE OF THE INVENTION

A hydraulically-actuated fuel injector includes an injector body having a nozzle chamber, a nozzle outlet, an actuation fluid inlet, at least one actuation fluid drain, an actuation fluid cavity and a pressure relief passage extending between the actuation fluid cavity and the actuation fluid drain. A hydraulic means, which includes an actuation fluid control valve mounted within the injector body, pressurizes fuel in the nozzle chamber. A needle valve member is mounted to reciprocate in the nozzle chamber between an open position in which the nozzle outlet is opened and a closed position in which the nozzle outlet is closed. A relief valve is mounted within the injector body and has a first position in which the pressure relief passage is closed and a second position in which the pressure relief passage is open.

One object of the present invention is to dissipate pressure spikes in the actuation fluid of hydraulically-actuated fuel injectors.

Another object of the present invention is to avoid pressure spike conditions in the actuation fluid of hydraulically-actuated fluid injectors with direct control needle valves.

Still another object of the present invention is to provide an improved hydraulically actuated fuel injector.

BRIEF DESCRIPTION OF THE DRAWINGS

FIGS. 4*a–g* are graphs of component positions and injection parameters, with and without the present invention, over a single injection event.

BEST MODE FOR CARRYING OUT THE INVENTION

Figure 1:
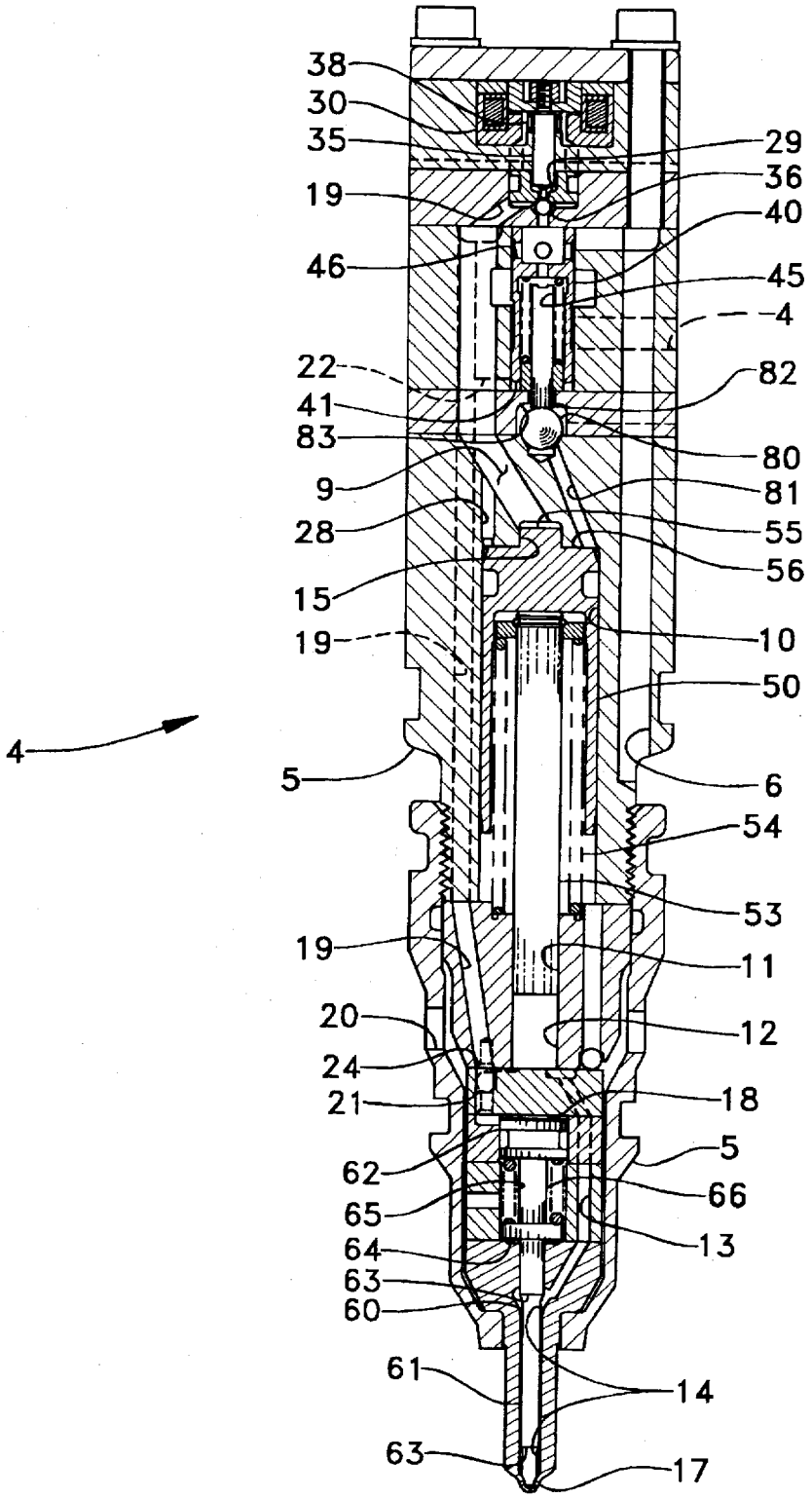
FIG. 1 is a sectioned side elevational view of a fuel injector according to the present invention.
Figure 2:
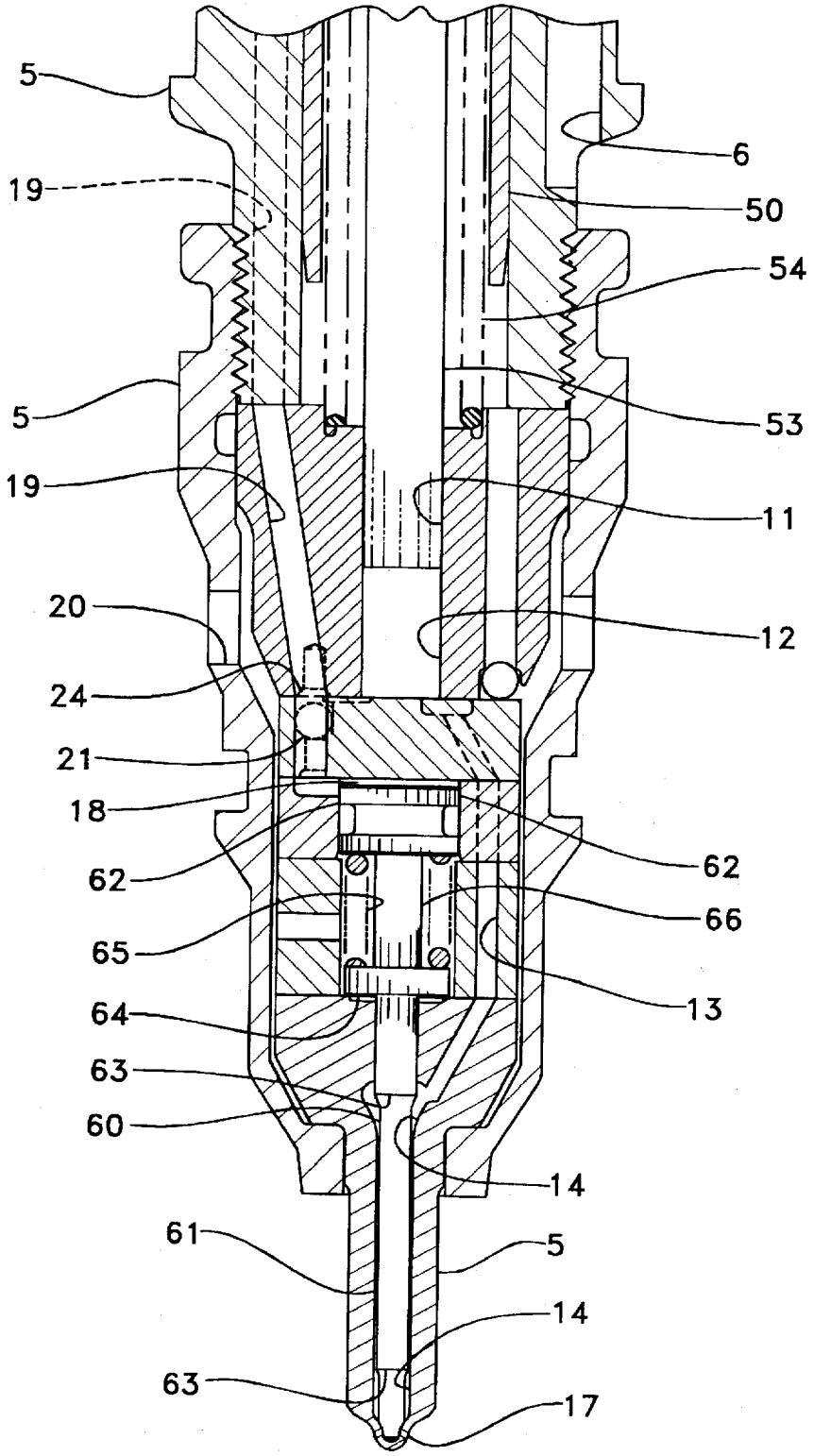
FIG. 2 is a partial sectioned side elevational view of an upper portion of the fuel injector shown in FIG. 1.
Figure 3:
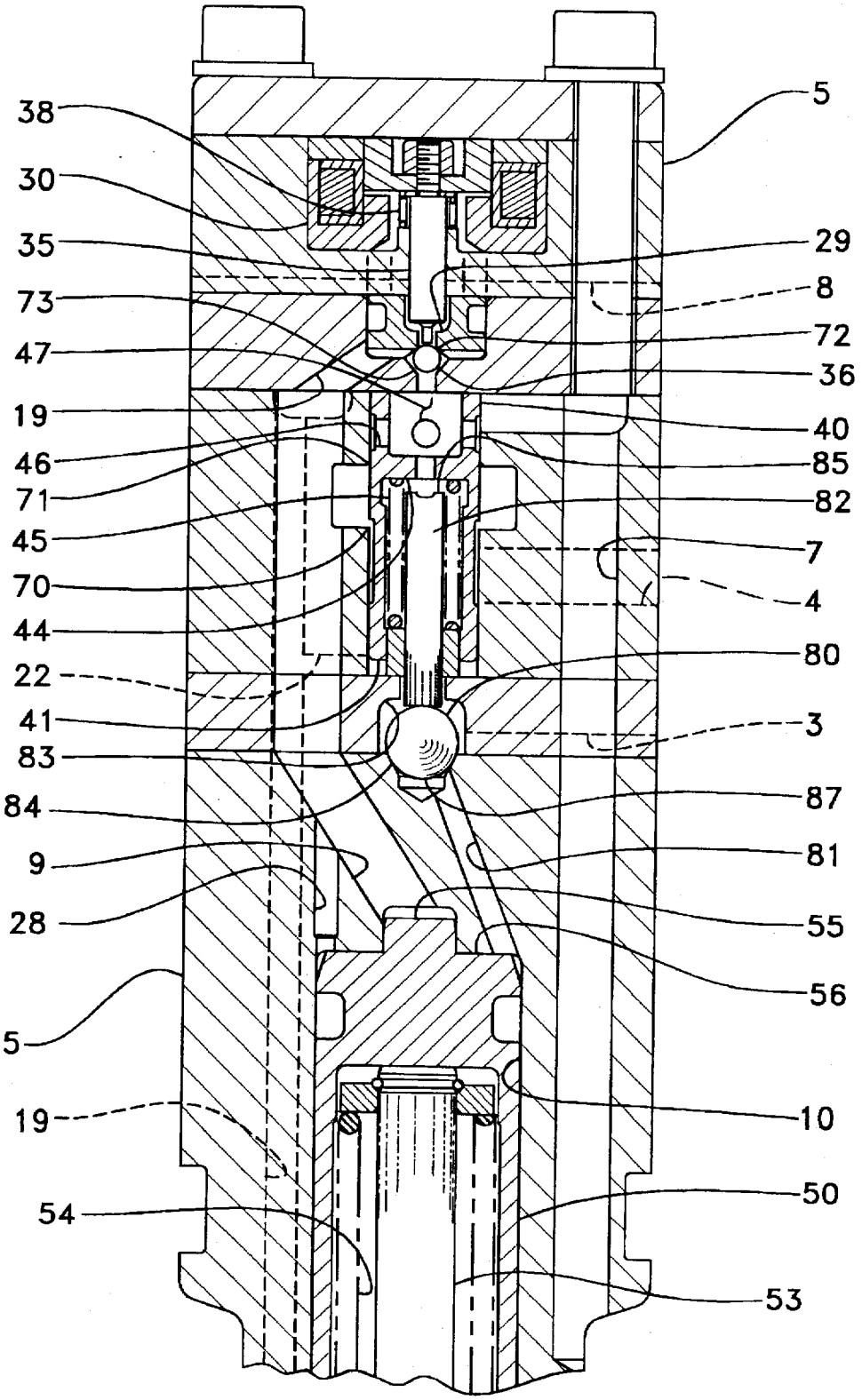
FIG. 3 is a partial sectioned side elevational view of a lower portion of the injector shown in FIG. 1.

Referring now to FIGS. 1–3, fuel injector 2 utilizes a single two-way solenoid 30 to alternately open actuation fluid cavity 9 to actuation fluid inlet 6 or low pressure actuation fluid drain 4, and uses the same solenoid 30 to control the exposure of a needle control chamber 18 to a low pressure passage or a source of high pressure fluid. The single two-way solenoid of injector 2 accomplishes direct control of the needle valve by exploiting a hysteresis effect in the actuation fluid control valve versus the quick response of the needle valve member to the needle control valve. Injector 2 includes an injector body 5 having an actuation fluid inlet 6 that is connected to source of high pressure actuation fluid, such as lubricating oil, an actuation fluid drain 4 that is connected to a low pressure actuation fluid recirculation line, and a fuel inlet 20 connected to a source of fuel. Injector 2 includes a hydraulic means for pressurizing fuel within the injector during each injection event and a needle control valve that controls the opening and closing of nozzle outlet 17.

The hydraulic means for pressurizing fuel includes an actuation fluid control valve that includes two-way solenoid 30 which is attached to a pin 35. An intensifier spool valve member 40 responds to movement of pin 35 and ball valve member 36 to alternately open actuation fluid cavity 9 to actuation fluid inlet 6 or low pressure drain 4. Actuation fluid cavity 9 opens to a stepped piston bore 10, 15 within which an intensifier piston 50 reciprocates between a return position (as shown) and a forward position. Actuation fluid cavity 9 can be thought of as including inner bore 15 and the upper part of bore 10 when piston 50 is in its forward position. Injector body 5 also includes a plunger bore 11, within which a plunger 53 reciprocates between a retracted position (as shown) and an advanced position. A portion of plunger bore 11 and plunger 53 define a fuel pressurization chamber 12, within which fuel is pressurized during each injection event. Plunger 53 and intensifier piston 50 are returned to their retracted positions between injection events under the action of compression spring 54. Thus, the hydraulic means for pressurizing fuel includes the fuel pressurization chamber 12, plunger 53, intensifier piston 50, actuation fluid inlet 6, actuation fluid cavity 9 and the various components of the actuation fluid control valve, which includes solenoid 30, ball 36, pin 35 and intensifier spool valve member 40, etc.

Fuel enters injector 2 at fuel inlet 20 and travels past ball check 21, then along a hidden fuel supply passage 24, into fuel pressurization chamber 12, when plunger 53 is retracting. Ball check 21 prevents the reverse flow of fuel from fuel pressurization chamber 12 into the fuel supply passage during the plunger's downward stroke. Pressurized fuel travels from fuel pressurization chamber 12 via a connection passage 13 to nozzle chamber 14. A needle valve member 60 moves within nozzle chamber 14 between an open position in which nozzle outlet 17 is open and a closed position in which nozzle outlet 17 is closed. In this embodiment, needle valve member 60 includes a lower needle portion 61 and an upper intensifier portion 62 separated by spacers 64 and 66, which are all machined as separate components, but could be machined as a single integral piece if spring 65 were relocated. Needle valve member 60 is mechanically biased to its closed position by compression spring 65.

Needle valve member 60 includes opening hydraulic surfaces 63 exposed to fluid pressure within nozzle chamber 14 and a closing hydraulic surface 67 exposed to fluid pressure within needle control chamber 18. The closing hydraulic surface and the opening hydraulic surfaces are sized and arranged such that the needle valve member 60 is hydraulically biased toward its closed position when the needle control chamber 18 is open to a source of high pressure fluid. Thus, there should be adequate pressure on the closing hydraulic surface 67 to maintain nozzle outlet 17 closed despite the presence of high pressure fuel in nozzle chamber 14 that could be above a valve opening pressure. The opening hydraulic surfaces 63 and closing hydraulic surface 67 are also preferably sized and arranged such that needle valve member 60 is hydraulically biased toward its open position when the needle control chamber 18 is connected to a low pressure passage and the fuel pressure within nozzle chamber 14 is greater than the valve opening pressure necessary to overcome return spring 65.

The actuation fluid control valve of injector 2 can be thought of as including two-way solenoid 30, which is attached to a pin 35 that is capable of contacting ball 36. Pin 35 is biased by a compression spring 38, and the hydraulic force on ball 36, toward a retracted position. In this position, ball 36 closes seat 72 and opens seat 73. This allows high pressure actuation fluid to flow into contact with the end hydraulic surface 41 of intensifier spool valve member 40 via a hidden connection passage 22 and a portion of actuation fluid control passage 19. When solenoid 30 is de-energized, actuation fluid cavity 9 is opened to actuation fluid drain 4 past seat 70, and intensifier spool valve member 40 is hydraulically balanced and forced up, as shown, to close seat 71 and open seat 70.

When solenoid 30 is energized, pin 35 moves downward causing ball 36 to open seat 72 and close seat 73. This causes end hydraulic surface 41 to be exposed to the low pressure in drain passage 29, which is connected to actuation fluid drain 4 outside injector body 5 via a second drain passage 8. This creates a hydraulic imbalance in intensifier spool valve member 40 causing it to move downward against the action of compression spring 45 to close seat 70 and open seat 71. This allows actuation fluid to flow from inlet 6, into the hollow interior 47 of intensifier spool valve member 40, through radial openings 46, past seat 71 and into actuation fluid cavity 9 to act upon the stepped top 55 of the intensifier piston 50.

The opening and closing of the nozzle outlet 17 via needle valve member 60 is controlled by the needle control valve which also includes solenoid 30. As stated earlier, when de-energized, pin 35 retracts under the action of compression spring 38 so that high pressure actuation fluid flowing through hollow interior 47 pushes ball 36 to open seat 73 and close seat 72. When in this configuration, the high pressure actuation fluid inlet 6 flows past seat 73 along a hidden passage into actuation fluid control passage 19. Actuation fluid control passage 19 opens to needle control chamber 18 and acts upon the closing hydraulic surface 67 of needle valve member 60, pushing the same downward to close nozzle outlet 17. When solenoid 30 is energized, pin 35 is moved downward causing ball 36 to close seat 73 and open seat 72. This opens actuation fluid control passage 19 to the low pressure within drain passage 29, which is connected to a second low pressure actuation fluid drain 8. Thus, with the solenoid 30 energized, the closing hydraulic surface 67 of needle valve member 60 is now exposed to a low pressure passage and the needle valve member begins to behave like a simple check valve in that it will now open if fuel pressure within the nozzle chamber 14 is greater than a valve opening pressure sufficient to overcome return spring 65. In this embodiment, the needle control valve includes solenoid 30, pin 35, ball 36, seat 72 and seat 73. The actuation fluid control valve includes all the components of the needle control valve plus intensifier spool valve member 40, compression spring 45, seat 70 and seat 71.

In some instances, when needle valve member 60 abruptly closes nozzle outlet 17 while piston 50 and plunger 53 are moving in their downward stroke, a pressure spike can be created due to the abrupt stopping of the plunger and piston due to the abrupt closure of the nozzle outlet. This pressure spike in the actuation fluid cavity 9 temporarily raises the actuation fluid pressure above that in the common rail (not shown) connected to high pressure actuation fluid inlet 6. This pressure spike phenomenon can sometimes cause an undesirable and uncontrolled secondary injection, due to an interaction of components and passageways over a brief instant after main injection has ended. In order to vent pressure spikes from actuation fluid cavity 9, a pressure relief passage 81 extends between actuation fluid cavity 9 to a third low pressure drain 3, which merges with drains 4 and 8 outside of injector body 5.

It is important to note that pressure relief passage 81 is preferably open to actuation fluid cavity 9 via an upper portion of piston bore 10 in the area above outer top surface 56. A portion of pressure relief passage 81 is machined into a seat 84 which receives relief ball 80. A relief pin 82 has one end in contact with relief ball 80 and another end having a hydraulic surface 85 exposed to the pressure of actuation fluid inlet 6, via hollow interior 47, radial openings 46 and high pressure actuation fluid inlet 6. Relief ball 80 includes a hydraulic surface 87 exposed to pressure in actuation fluid cavity 9 via pressure relief passage 81 and the upper portion of piston bore 10. Hydraulic surfaces 85 and 87 are sized and arranged such that relief pin 82 holds relief ball 80 in seat 84 when pressure in actuation fluid cavity 9 is below a threshold pressure, which is preferably lower than the common rail pressure leading to actuation fluid inlet 6. Thus, pressure relief passage 81 remains closed as long as the pressure acting on hydraulic surface 87 of ball 80 is less than the threshold pressure (see FIG. 4*d*).

During injection events spool valve member 40 contacts pin 82 when in its lower open position. Thus, no loss of pressure occurs through pressure relief passage during an injection event since the combined hydraulic forces on spool valve member 40 and pin 82 are sufficient to hold ball 80 in seat 84.

When injection ends, end hydraulic surface 41 of spool valve member is again exposed to high pressure actuation fluid, preferably oil, past seat 73. With the spool valve member hydraulically balanced, ball 80 lifts off of seat 84 and the combined forces of spring 45 and the pressure on ball 80 begin the spool valve member 40 moving upward. Thus, the force from ball 80 acting through pin 82 contacting on surface 44 of spool valve member 40 hastens its movement upward to open drain seat 70 and close high pressure seat 71. At the same time ball 80 provides a boost to hasten the movement of spool valve member 40, it also opens actuation fluid cavity 9 to a third low pressure drain 3 via pressure relief passageway 81 for a brief time period before seat 71 closes. This occurs while high pressure actuation fluid continues to pour into actuation fluid cavity 9 past seat 71. The pressure relief valve, which includes pin 82, ball 80 and seat 84, prevents the immediate over build-up of pressure following an injection event by allowing some high pressure actuation fluid to escape to drain, and also hastens the closure of high pressure seat 71.

By exploiting the opening of ball 80 to give spool valve member 40 a boost in moving from its open to closed positions, the size of ball 80 and pressure relief passage 81 can be made smaller than would otherwise be required if a simple check valve to drain were utilized. In other words, if ball 80 were held in seat 84 by a simple spring, spool valve member 40 would return more slowly only under the action of relatively weak return spring 45 so the relief passageway would necessarily need to accommodate a much larger volume of flow since high pressure seat 71 would be closing much more slowly. In order to prevent ball 80 from opening before main injection begins, pressure relief passage 81 opens to the upper portion of piston bore 10. Since the area above outer surface 56 of piston 50 does not experience full actuation fluid pressure until center top 55 clears upper piston bore 15, the pressure in pressure relief passage 81 remains well below the threshold pressure necessary to open ball 80 during the beginning portion of each injection event.

Industrial Applicability

Referring now also to the graphs of FIGS. 4*a–g*, each injection sequence is started by energizing the solenoid 30 in order to move ball 36 to open seat 72 and close seat 73. The pressurized fluid previously acting on end hydraulic surface 41 of spool valve member 40 can now drain past seat 72. Intensifier spool valve member 40 is now hydraulically imbalanced and begins to move downward against the action of compression spring 45. This opens seat 71 and closes seat 70. These events are illustrated in FIGS. 4*a–c*. The main oil supply can now flow through radial openings 46, past seat 71, into actuation fluid cavity 9 to the top of intensifier piston 50, starting it moving downward. With intensifier piston 50 and plunger 53 moving downward, fuel pressure starts to build within fuel pressurization chamber 12, closing ball check 21. With the solenoid energized, needle control passage 19 is open to low pressure drain 29 such that needle valve member 60 will open when fuel pressure exceeds a valve opening pressure sufficient to compress return spring 65. (See the drop in pressure in FIG. 4*e*).

Since only the inner top portion 55 of intensifier piston 50 is exposed to the high pressure oil in actuation fluid cavity 9, the intensifier piston accelerates downward at a rate lower than it otherwise would if the full fluid pressure were acting over the complete top surface of the intensifier piston. The volume above the annular top surface 56 of intensifier piston 50 is filled by fluid flowing through auxiliary passage 28. As the intensifier piston continues to move downward, it eventually reaches a point where the volume above space 56 is growing faster than fluid can be supplied via passage 28. This causes a momentary hesitation in the piston's downward movement resulting in a slower build-up of fuel pressure underneath plunger 53 in fuel pressurization chamber 12. It is important to note that the relief ball 80 remains seated (FIG. 4*c*) during the beginning of the split injection sequence shown in FIGS. 4*a–g* this is because the pressure on the outer surface 56 of the intensifier piston, where pressure relief passage 81 opens, remains below the threshold pressure at the beginning of the injection sequence (see FIG. 4*d*).

In order to produce the split (pilot-main) injection of FIG. 4*g*, solenoid 30 is initially energized with a maximum pull-in current so that ball 36 moves to open seat 72 and close seat 73. Shortly after the ball moves, the intensifier spool valve member begins to move from its closed position to its open position so that high pressure actuation fluid begins to flow into actuation fluid cavity 9, beginning the piston and plunger moving in their downward stroke. When fuel pressure within nozzle chamber exceeds the valve opening pressure sufficient to compress return spring 65, the needle valve member briefly opens to allow a pilot injection segment to occur.

In order to produce a split injection, the solenoid is briefly de-energized a sufficient amount of time that the ball 36 moves back to its original position to open seat 73 and close seat 72. This again pressurizes the closing hydraulic surface of needle valve member 60 causing it to close (see FIG. 4*e*). At the same time, intensifier spool valve member 40 becomes hydraulically balanced and begins to move to close seat 71 (see area A of FIG. 4*c*). However, because spring 45 is relatively weak and pressure under relief ball 80 is insufficient to provide a boost, the intensifier spool valve member moves rather slowly. Before intensifier spool valve member moves sufficiently far to close seat 71, the solenoid is again energized causing ball 36 to again close seat 73 and re-open seat 72. This allows needle valve member 60 to re-open with fuel pressure substantially higher than the valve opening pressure in order to provide an abrupt beginning, or "square" to the injection. At the same time, intensifier spool valve member 40 reverses direction and returns to its fully open position. This slight movement of spool valve member 40 can be seen as area A in FIG. 4*c*. Thus, since ball 36 and needle valve member 60 can react far quicker to the movement of solenoid 30, the needle control valve can be opened and closed faster than the intensifier spool valve member can react to close seat 71 at the beginning of an injection event.

To end injection and allow the injector to re-fuel itself for the next cycle, solenoid 30 is de-energized. This causes ball 36 to open seat 73 and close seat 72. This resumes the pressurized actuation fluid acting on closing hydraulic surface 67 of needle valve member 60 to close and nozzle outlet 17 provide an abrupt end to the injection. The opening of seat 73 causes intensifier spool valve member 40 to again become hydraulically balanced so that compression spring 45, with help from the boost provided by the lifting of pressure relief ball 80 (see FIG. 4*c*) moves the same upward to close seat 71 and open seat 70. While this is occurring actuation fluid in actuation fluid cavity 9 drains initially through pressure relief passage 81 and eventually into actuation fluid drain 4 when seat 70 finally opens. Ball 80 returns to its seat when seat 70 opens drain 4. This permits intensifier piston 50 and plunger 53 to retract under the action of return spring 54. The lowering of fuel pressure within fuel pressurization chamber 12 causes ball check 21 to open. Replenishing fuel begins to flow into the injector for the next injection event.

If a "ramp-square" injection profile is desired, current to solenoid 30 is continued throughout the duration of the injection event. After the ball and spool have moved due to the initial energization of solenoid 30, the solenoid current is dropped to a hold-in current which keeps the solenoid pin in its same position yet saves energy since less energy is required to hold pin 35 in this position. Because of the slower acceleration and hesitation produced in the movement of intensifier piston 50 by the use of a stepped top in a stepped bore, the initial mass injection rate desirably ramps upward in a way that improves exhaust emissions over certain engine operating conditions. Thus, in this injector, simple energizing and de-energizing of the solenoid will result in a ramped initial injection rate due to the intensifier piston stepped top and an abrupt end to injection due to the direct needle valve member control features.

Those skilled in the art will appreciate that by having pressure relief passage 81 only exposed to the full pressure of actuation fluid cavity 9 after the main injection sequence has begun, pressure relief passage 81 only becomes important after piston 50 has moved to provide a direct pressure connection to the pressure of actuation fluid inlet 6.

FIGS. 4*a–g* illustrate that the positions of the various components and the various injection parameters are substantially identical in the fuel injector shown in FIGS. 1–3 with and without the relief valve of the present invention, except at the end portion of the injection event. FIG. 4*g* shows that without the pressure relief passage and valve, an undesirable secondary injection occurs after the main injection sequence. This occurs despite the fact that FIGS. 4*a–b* illustrate that the current to the injectors are identical and the position of the control ball 36 is identical. However, FIGS. 4*c–f* illustrate why the secondary injection occurs. FIG. 4*c* illustrate that without the relief valve, the spool moves from its open to its closed position much slower than the case where the relief valve is included. This is important since FIG. 4*d* shows that by leaving the high pressure inlet open, pressure surges in the actuation fluid cavity above the common rail pressure. This in turn causes a surge in fuel pressure as seen in FIG. 4*f*.

The opening of needle valve member 60 is controlled by the differential pressures acting on its closing hydraulic surface 67 (actuation fluid) and opening hydraulic surfaces 63 (fuel). This differential pressure can be extracted from FIGS. 4*e* and 4*f* to show that the pressure surge, which occurs when no relief valve is present, causes a brief and undesirable secondary injection to occur. With the pressure relief means of the present invention, the pressure spike conditions which could otherwise cause a secondary injection are vented via pressure relief passage 81 and avoided by the quicker closure of spool valve member 40.

Those skilled in the art should appreciate that while the injector illustrated in FIGS. 1–3 shows one possible means of venting pressure from actuation fluid cavity 9, different valve structures could be utilized to open and close pressure relief passage 81, other than the relief valve structure illustrated. For instance, a spool or poppet valve could be substituted for the relief ball 80, relief pin 82 structure illustrated. Also, the relief valve could be mechanically biased to its closed position rather than hydraulically biased as in the illustrated embodiment. In any event, what is important is that the injector have a way of dissipating pressure spikes or avoiding pressure spike conditions within the injector.

Other aspects, objects, and advantages of this invention can be obtained from a study of the drawings, the disclosure, and the appended claims.

We claim:

1. A hydraulically actuated fuel injector comprising:

an injector body having an actuation fluid cavity, a needle control chamber, a nozzle chamber and a nozzle outlet that opens to said nozzle chamber;

hydraulic means, within said injector body, for pressurizing fuel in said nozzle chamber;

a needle valve member positioned to reciprocate in said nozzle chamber between an opened position in which said nozzle outlet is open and a closed position in which said nozzle outlet is closed, said needle valve member including a closing hydraulic surface exposed to pressure in said needle control chamber;

a needle control valve mounted within said injector body, and being movable between an off position in which said needle control chamber is opened to a source of high pressure fluid and an on position in which said needle control chamber is opened to a low pressure passage; and means, within said injector body, for venting post injection pressure from said actuation fluid cavity.

2. The fuel injector of claim 1, wherein said means for venting post injection pressure includes said injector body having a pressure relief passage extending between said actuation fluid cavity and a low pressure actuation fluid drain; and a relief valve mounted within said injector body and having a first position in which said pressure relief passage is closed and a second position in which said pressure relief passage is open.

3. The fuel injector of claim 2, wherein said relief valve being hydraulically biased toward said second position when pressure in said actuation fluid cavity exceeds a threshold pressure.

4. The fuel injector of claim 2, wherein said relief valve includes a relief ball; and a portion of said pressure relief passage being a seat for said relief ball.

5. The fuel injector of claim 4 wherein said relief valve further includes a relief pin with an end hydraulic surface exposed to pressure in said actuation fluid inlet and an other end capable of contacting said relief ball; and said relief ball includes a second hydraulic surface exposed to pressure in said actuation fluid cavity.

6. The fuel injector of claim 2 wherein said injector body includes a piston bore;

said actuation fluid cavity including a portion of said piston bore; and said pressure relief passage opens into said portion of said piston bore.

7. The fuel injector of claim 6 wherein said needle valve member includes an opening hydraulic surface exposed to pressure in said nozzle chamber;

said closing hydraulic surface and said opening hydraulic surface are sized and arranged such that said needle valve member is hydraulically biased toward said closed position when said needle control chamber is opened to said source of high pressure fluid.

8. The fuel injector of claim 5 wherein said hydraulic means for pressurizing fuel includes a spool valve member; and said one end of said relief pin is in contact with said spool valve member when said spool valve member is in a position that opens said actuation fluid cavity to an actuation fluid inlet.

9. The fuel injector of claim 2 wherein said hydraulic means for pressurizing fuel includes an actuation fluid control valve and said injector body having an actuation fluid inlet; and said actuation fluid control valve having a pin attached to a solenoid, and including said injector body having a low pressure seat and a high pressure seat, and further including a ball positioned between said low pressure seat and said high pressure seat.

10. The fuel injector of claim 9 wherein said actuation fluid control valve further includes a spool valve member movable between a first position and a second position;

said spool valve member opens said actuation fluid cavity to said actuation fluid inlet and closes said actuation fluid drain to said actuation fluid cavity when in said first position;

said spool valve member closes said actuation fluid cavity to said actuation fluid inlet and opens said actuation fluid drain to said actuation fluid cavity when in said second position; and means, including a spring positioned in said injector body, for biasing said spool valve member toward said second position.

11. The fuel injector of claim 10 wherein said injector body includes an actuation fluid control passage;

said spool valve member having an end hydraulic surface exposed to pressure in said actuation fluid control passage, said high pressure seat separating said actuation fluid control passage and said actuation fluid inlet, and said low pressure seat separating said actuation fluid control passage and a low pressure drain passage; and said spool valve member being hydraulically biased toward said first position when said ball is seated in said high pressure seat and said actuation fluid control passage is open to said low pressure drain passage.

12. A hydraulically actuated fuel injector comprising:

an injector body having a nozzle chamber, a nozzle outlet, an actuation fluid inlet, an actuation fluid drain, an actuation fluid cavity and a pressure relief passage extending between said actuation fluid cavity and said actuation fluid drain;

hydraulic means, including an actuation fluid control valve mounted within said injector body, for pressurizing fuel in said nozzle chamber;

a needle valve member mounted to reciprocate in said nozzle chamber between an open position in which said nozzle outlet is open and a closed position in which said nozzle outlet is closed;

a relief valve mounted within said injector body and having a first position in which said pressure relief passage is closed and a second position in which said pressure relief passage is open.

13. The fuel injector of claim 12 wherein said actuation fluid control valve having a pin attached to a solenoid, and including said injector body having a low pressure seat and a high pressure seat, and further including a ball positioned between said low pressure seat and said high pressure seat.

14. The fuel injector of claim 13 wherein said actuation fluid control valve further includes a spool valve member movable between a first position and a second position;

said spool valve member opens said actuation fluid cavity to said actuation fluid inlet and closes said actuation fluid drain to said actuation fluid cavity when in said first position;

said spool valve member closes said actuation fluid cavity to said actuation fluid inlet and opens said actuation fluid drain to said actuation fluid cavity when in said second position; and means, including a spring positioned in said injector body, for biasing said spool valve member toward said second position.

15. The fuel injector of claim 14 wherein said injector body includes a actuation fluid control passage;

said actuation fluid control valve includes said spool valve member having an end hydraulic surface exposed to pressure in said actuation fluid control passage, said high pressure seat separating said actuation fluid control passage and said actuation fluid inlet, and said low pressure seat separating said actuation fluid control passage and a low pressure drain passage; and said spool valve member being hydraulically biased toward said first position when said ball is seated in said high pressure seat and said actuation fluid control passage is open to said low pressure drain passage.

16. The fuel injector of claim 12, wherein said actuation fluid control valve includes a spool valve member moveable between a first position and a second position;

said spool valve member opens said actuation fluid cavity to said actuation fluid inlet and closes said actuation fluid drain to said actuation fluid cavity when in said first position;

said spool valve member closes said actuation fluid cavity to said actuation fluid inlet and opens said actuation fluid drain to said actuation fluid cavity when in said second position; and said relief valve being hydraulically biased toward said second position when pressure in said actuation fluid cavity exceeds a threshold pressure.

17. The fuel injector of claim 16, wherein said relief valve includes a relief ball, a relief pin with one end capable of contacting said relief ball, and a portion of said pressure relief passage being a seat for said relief ball.

18. The fuel injector of claim 17 wherein said relief valve further includes said relief pin having an other end with a first hydraulic surface exposed to pressure in said actuation fluid inlet; and said relief ball includes a second hydraulic surface exposed to pressure in said actuation fluid cavity.

19. The fuel injector of claim 18 wherein said other end of said relief pin is in contact with said spool valve member when said spool valve member is in said first position.

20. The fuel injector of claim 12 wherein said injector body includes a piston bore;

said actuation fluid cavity including a portion of said piston bore; and said pressure relief passage opens into said portion of said piston bore.

* * * * *